US011808024B2

(12) United States Patent
Nivelles

(10) Patent No.: US 11,808,024 B2
(45) Date of Patent: Nov. 7, 2023

(54) SHOWER DRAIN

(71) Applicant: **GeNi*us BVBA**, Tienen (BE)

(72) Inventor: Geert Rita Erik Victor Nivelles, Tienen (BE)

(73) Assignee: **GENI*US BVBA**, Tienen (BE)

( * ) Notice: Subject to any disclaimer, the term of this patent is extended or adjusted under 35 U.S.C. 154(b) by 3 days.

(21) Appl. No.: 16/978,647

(22) PCT Filed: Mar. 5, 2019

(86) PCT No.: PCT/IB2019/000291
§ 371 (c)(1),
(2) Date: Sep. 4, 2020

(87) PCT Pub. No.: WO2019/171179
PCT Pub. Date: Sep. 12, 2019

(65) Prior Publication Data

US 2020/0407966 A1 Dec. 31, 2020

(30) Foreign Application Priority Data

Mar. 5, 2018 (NL) ..... 1042775

(51) Int. Cl.
*E03F 5/04* (2006.01)

(52) U.S. Cl.
CPC ..... *E03F 5/0408* (2013.01); *E03F 5/0409* (2013.01); *E03F 2005/0413* (2013.01)

(58) Field of Classification Search
CPC ..... E03F 5/0407; E03F 5/0408; E03F 2005/0413; E03F 2005/0412
See application file for complete search history.

(56) References Cited

U.S. PATENT DOCUMENTS 2,607,434 A * 8/1952 Sisk ..... E03F 5/0407 210/165
3,246,582 A * 4/1966 Clare ..... E03F 5/0407 210/164
6,143,168 A * 11/2000 Shackelford ..... E03F 5/06 210/474

(Continued)

FOREIGN PATENT DOCUMENTS

CH 698575 B1 9/2009
DE 202016104882 U1 9/2016

(Continued)

OTHER PUBLICATIONS

Search Report and Written Opinion from International Application No. PCT/IB2019/000291, completed Jul. 29, 2019, (11 pages).

(Continued)

*Primary Examiner* — Kevin F Murphy
(74) *Attorney, Agent, or Firm* — Troutman Pepper Hamilton Sanders LLP; Ryan A. Schneider; Korbin Blunck

(57) ABSTRACT

A drain (1) is described for mounting in a floor (V), comprising: a collecting container (10) with a bottom (11) and standing side walls (12) which at their upper end are provided with a flange (13) directed outwards; and a covering frame (200) for covering side edges of tiles (T) of this floor. The frame is kept at the correct height by means of a temporary positioning aid (100), to be subsequently attached to said tiles (T) by means of glue or kit (210). After that, the positioning aid (100) is removed.

32 Claims, 6 Drawing Sheets

(56) References Cited

U.S. PATENT DOCUMENTS

| | | | | |
|---|---|---|---|---|
| 8,474,068 | B2 * | 7/2013 | Kik, Sr. | E03F 5/0409 4/679 |
| 8,486,260 | B2 * | 7/2013 | Tripodi | E03F 5/14 210/232 |
| 8,967,190 | B2 * | 3/2015 | Keizers | E03F 5/0407 137/362 |
| 9,567,738 | B2 | 2/2017 | Schluter | |
| 10,544,576 | B2 * | 1/2020 | Ismert | E03F 5/0401 |

FOREIGN PATENT DOCUMENTS

| | | | |
|---|---|---|---|
| EP | 2806075 | A1 | 11/2014 |
| EP | 3392420 | A1 | 10/2018 |
| NL | 2002767 | C2 | 10/2010 |
| NL | 2016737 | B1 | 11/2017 |

OTHER PUBLICATIONS

Search Report and Written Opinion from NL Application No. 1042775, dated Mar. 7, 2018 , (7 pages).

* cited by examiner

SHOWER DRAIN

FIELD OF THE INVENTION

The invention relates to a discharge drain for mounting in floors, particularly but not exclusively tiled bathroom floors and/or shower spaces. In the following, the invention will be explained for the example of tiled bathroom floors and shower space.

BACKGROUND OF THE INVENTION

Discharge drains of the mentioned type are well known. They serve to collect water (or other liquid) that flows away from the (usually slightly sloping) floor and to discharge this to the sewer. For this purpose, a drain comprises a (usually elongate) collecting container that has, in a bottom or a sidewall, an outlet opening for connection to a discharge pipe system. In order to prevent nuisance as a result of sewer odours, the outlet opening is typically provided with a stench block, also indicated as siphon.

The collecting container has a bottom and upstanding sidewalls, of which the upper edges define the inlet opening of the collecting container. Around the sidewalls, the collecting container has a flange directed outwards. The collecting container is mounted in the floor concerned, in such a way that the said upper edges are in a horizontal plane as good as possible. This plane is not allowed to be higher than the final floor surface, or else the water lying on this floor surface cannot run away well. In order to ensure a good efflux of water, in practice said upper edges are in fact mounted slightly lower than the final floor surface.

The final floor surface is formed by floor tiles. First the discharge drain is placed in the not yet finished floor, and later the floor tiles are arranged. In order to make these tiles connect well to the upper edge of the collecting container, it will usually be necessary to saw or cut the tiles in order to have the correct size. In this case, the tile obtains a fracture plane as sidewall. This fracture plane extending above the upper edge of the collecting container is not nice to see. Furthermore, this fracture plane has a sharp upper edge; there is then the danger that a barefoot user injures himself with this sharp edge.

It is desirable to counteract this.

For that purpose, it is known to place a covering framework adjacent these tiles. The covering framework has a contour corresponding to the contour defined by the cut tiles. This contour obviously corresponds to the contour of the upper edge of the collecting container, which usually is a rectangular contour.

The procedure is that one first places the discharge drain, and then arranges the tiles, lying over the flange of the drain. After that, one places the covering framework. It is generally not exactly known in advance how high the upper edge of the tiles comes to lie with respect to the drain, since this depends among other things on the tile thickness and on the practical tolerances on placement. Therefore, adjustment means must be provided in order to adapt the height position of the covering framework to the actual height of the tiles.

EP-2140072 describes an example in which the rectangular covering framework is provided with transverse pieces located within the framework and attached to this framework, with support legs screwed therein. The whole stands loosely on the bottom of the collecting container. It is possible to rotate the support legs from above, through which a height adjustment of the covering framework with respect to the bottom of the collecting container is effected, and thus a height adjustment of the framework with respect to the tiles is achieved.

A discharge drain of the present type will always be provided with a cover that on the one hand passes water sufficiently and on the other hand is suitable for a user to stand on. An often seen embodiment of such cover is a grating. Since it is perceived by the user as unpleasant if there are large differences in level, it is desirable that the cover has a planar topside that is flush with the level of the upper surface of the tiles. For comparable reasons as mentioned above, it is therefore desirable that adjustment means are provided for adapting the height position of the cover to the actual height of the tiles.

In the example mentioned of EP-2140072, a grating is lying loosely on the said transverse pieces. Adjustment means for adjusting the height position of the grating with respect to the said transverse pieces are not provided. Therefore, the grating always has the same height with respect to the said transverse pieces and thus with respect to the covering framework. On adjustment of the height of the covering framework, an adjustment of the height of the grating with respect to the tiles is therefore also achieved automatically. Furthermore, it is a disadvantage that it is not possible to vary with finishings for the grating having different thickness.

A disadvantage of this design proposed in EP-2140072 is that the support legs are positioned in the liquid path on the bottom of the collecting container. With time, fouling can occur here, for instance by collecting hairs and soap rests sticking to the support legs. Further, dirt can accumulate under the transverse parts and under the covering framework. The fouling as such is already undesired, for reason that it is unhygienic and unpleasant odors can emanate. Furthermore, the fouling can affect the water draining capacity of the drain.

A user will wish to clean the drain with some regularity. In such case, it is of importance that the collecting container is free from obstacles, because each obstacle is per definition a place where thorough cleaning is not possible or in any case very difficult.

As long as the covering framework with its transverse pieces and the support legs is standing loosely on the bottom of the collecting container, it is still possible to clean the drain in the case of this design proposed in EP-2140072, although it is a disadvantage that it is necessary to also clean the support legs, which is rather cumbersome. But in practice one will wish to seal up the gap between the covering framework and the tiles after installation, and/or one will wish to arrange a sealing between the covering framework and the edge of the collecting container, as is also suggested in the publication. In that case, it is no longer possible to remove the covering framework with its transverse pieces and support legs, and a thorough cleaning is hence impossible or at least very difficult.

SUMMARY OF THE INVENTION

A general objective of the present invention is to provide a design that does not have these disadvantages.

According to a first aspect of the present invention, the covering framework is suspended from the tiles by means of an adhesive. Consequently, the covering framework can be free from height adjustment means and particularly, for positioning and maintaining the covering framework at the desired height, no support legs or other obstacles are present which support on the bottom of the drain and thus hinder the free flow of water.

According to a second aspect of the present invention, on mounting the covering framework, use is made of a mounting aid that is adjustable in height, and that holds the covering framework in the correct position and particularly at the correct height, so that one can apply the adhesive, for instance in the form of a glue or mortar. After sufficient hardening of the adhesive, the mounting aid is removed. In an embodiment, the mounting aid is made of a sturdy but manually breakable material, such as cardboard, papier-mâché, styrofoam. Since the precise shaping of the temporary mounting aid is not critical, and since this can be made from a cheap material, the manufacturing costs of the design system as a whole are lower.

In a variation, a covering framework with the temporary mounting aid is placed on the drain even before the tiles have been laid, and the tiles are laid while the framework is already lying in place. Then, the framework can serve as targeting means and even as support means while tiling.

After tiling, and adjusting the covering framework at the correct height flush with the upper edge of the tiles, one proceeds with gluing the framework to the tiles, as described above.

In a further variation, a temporary covering cap with integrated tile support is provided additionally. The covering cap lies over the covering framework and extends over the inlet opening of the collecting container, and prevents debris (for instance tile mortar) from entering the collecting container. The covering cap has a free end that is provided with a support edge against which the tiles can be laid on tiling. In such way it can be ensured that the gap between the covering framework and the tiles has a constant thickness over the full length.

In a preferred embodiment, the covering framework has four framework segments placed in a rectangle, wherein each segment has a rectangular contour (I-profile). In another embodiment, at least two framework segments have an L-shape contour (L-profile) at least over a part of their length, wherein the foot of the L only needs to have a horizontal size in the order of 1 mm. This foot of the L then forms a supporting edge for a reverse U-shaped grating.

In all cases mentioned, the bottom of the drain is freely accessible for cleaning purposes. In a further variation, cleaning of the wall of the drain directly below the framework is facilitated if the framework is bevelled at its lower side.

According to a third aspect of the present invention, a grating is provided that is positioned independent from the covering framework. In an embodiment, the side wall of the drain is provided with two inwardly projecting parts onto which a grating support can be placed. This grating support thus remains free from the bottom and does not form an obstacle for draining water. The grating bears on this grating support. Preferably, grating and grating support are clamped together. When one removes the grating, the grating support automatically comes along, and the entire bottom of the drain is then free and can be cleaned.

The grating support has multiple rotational positions, which define different clamping heights of the grating. In order to increase the adjustment range, further pads can be clamped under the grating support.

BRIEF DESCRIPTION OF THE DRAWINGS

These and other aspects, features and advantages of the present invention will be further clarified by the following description of one or more exemplary embodiments with reference to the drawings, in which same reference numerals indicate same or similar parts, in which indications "below/above", "higher/lower", "left/right" etc. exclusively relate to the orientation shown in the drawings and in which.

DETAILED DESCRIPTION OF THE INVENTION

Figure 1A:
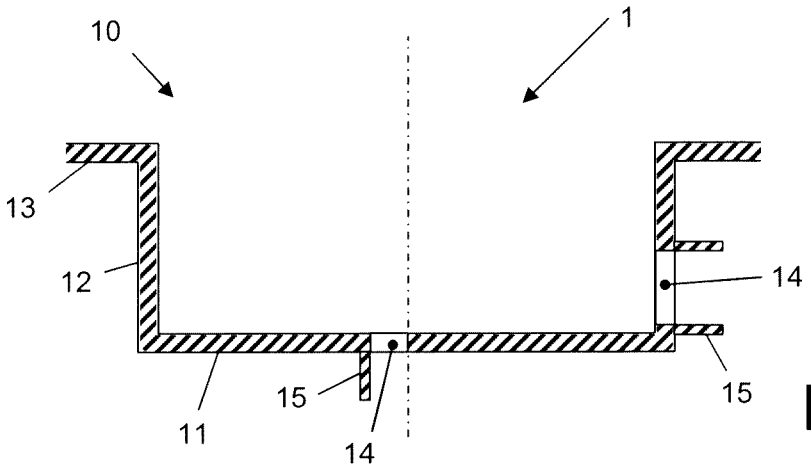
FIG. 1A schematically shows a cross section of a collecting container.

FIG. 1A schematically shows a cross section of an elongate collecting container 10 with a substantially rectangular contour, of a drain 1. The collecting container 10 has a bottom 11 with a substantially rectangular contour, and standing side walls 12 that at their upper end are provided with a flange 13 directing outwards. Said upper ends surround the open upper side of the collecting container 10, which is an inlet opening of the collecting container 10, through which water can flow into the collecting container from above. The collecting container 10 is provided with an outlet opening 14 in the bottom 11 (shown in the left half of the figure) or in the side wall 12 (shown in the right half of the figure). An integrated connection pipe 15 can be provided at that outlet opening, for connecting thereto a drain pipe, but such connecting pipe part can also be a separate part that is to be connected, or be part of a siphon to be placed later.

The collecting container 10 may be made of a relatively thin plate material, for instance a type of steel or a type of aluminium, for instance by deep pressing. In such situations, along the upper edge, the flange offers a larger surface for being overlapped by a tile. The collecting container 10 may also be made of a relatively thick material, thick to such extent that a folded flange is no longer necessary because the free upper edge of the side walls is then sufficiently thick for being overlapped by a tile.

Figure 1B:
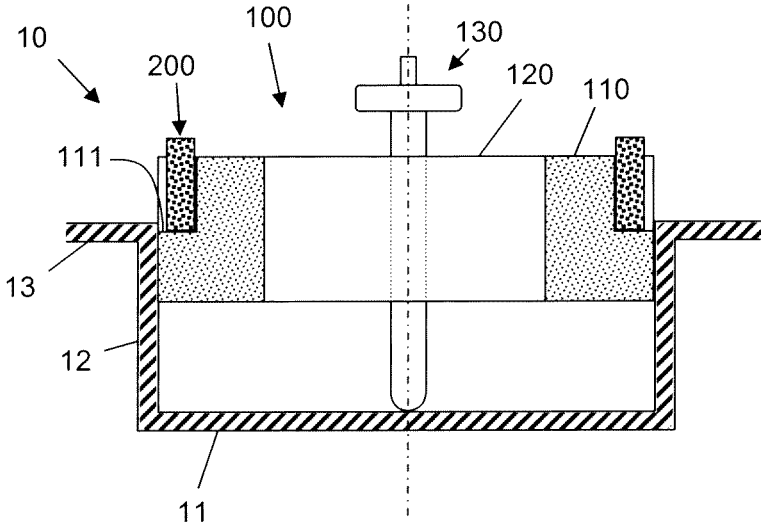
FIGS. 1B-1E show details of a drain according to the present invention and illustrate steps of mounting it.

FIG. 1B is a cross section comparable to FIG. 1A, in which for sake of simplicity the outer opening 14 and the connecting pipe 15 are omitted, and wherein a positioning aid 100 is placed in the collecting container 10.

Figure 2:
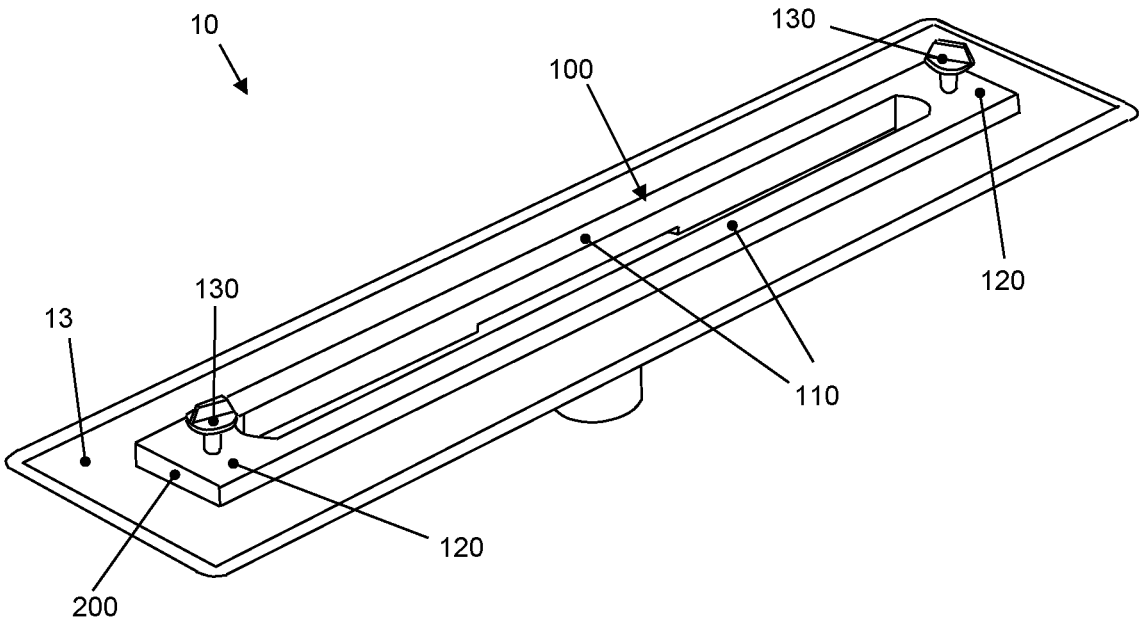
FIG. 2 schematically shows a perspective view of a collecting container with positioning aid.

FIG. 2 is a schematic perspective view of the collecting container 10 with the positioning aid 100. In the exemplary embodiment as shown, the positioning aid 100 is an elongate piece of material with an elongate central recess, so that the positioning aid 100 comprises two elongate side parts 110 and two short end pieces 120. In those end pieces 120, adjustment screws 130 are screwed, of which the lower end supports on the bottom 11. At its outer side, the positioning aid 100 is stepped, with a shoulder 111 directed outwards, onto which a covering frame 200 is resting.

The material of the positioning aid 100 is not essential. In a possible embodiment, the material can be styrofoam. In other possible embodiments it is possible that for instance cardboard or papier-mâché are chosen. A combination of said materials is also possible.

As will be described in the following, the position aid 100 is designed to be easily removable after use, whereas in such case the covering frame 200 remains in place. Then, the covering frame 200 forms a passage through which the larger positioning aid 100 must pass. To this end, the positioning aid 100 may be designed to be easily shredded or broken into smaller pieces, as in the case of the materials mentioned above. It is also possible that the positioning aid 100 is designed to be easily deformed to a smaller shape, such as for instance when the positioning aid is made of relatively thin plastic, or at least is provided with easily deformable portions. The positioning aid 100 may be provided with pre-shaped folding lines and/or tearing lines. The positioning aid 100 may be built from separate components that can shift or hinge with respect to each other. If desired, it is even possible that the positioning aid 100 is formed by a collection of positioning aids that are individually adjustable in height and that collectively support the covering frame 200 temporarily while each positioning part by itself is smaller than the passage of the covering frame 200.

The positioning aid 100 may be designed for one time use only. Crumbling or deformation to smaller size to fit through the passage of the covering frame 200 may be irreversible in such case. It is also possible that the positioning aid 100 can be used multiple times, for instance because it can be deformed to a smaller size passing through the passage of the covering frame 200 in a non-destructive manner, for instance by parts that can hinge or bend elastically.

Figure 1C:
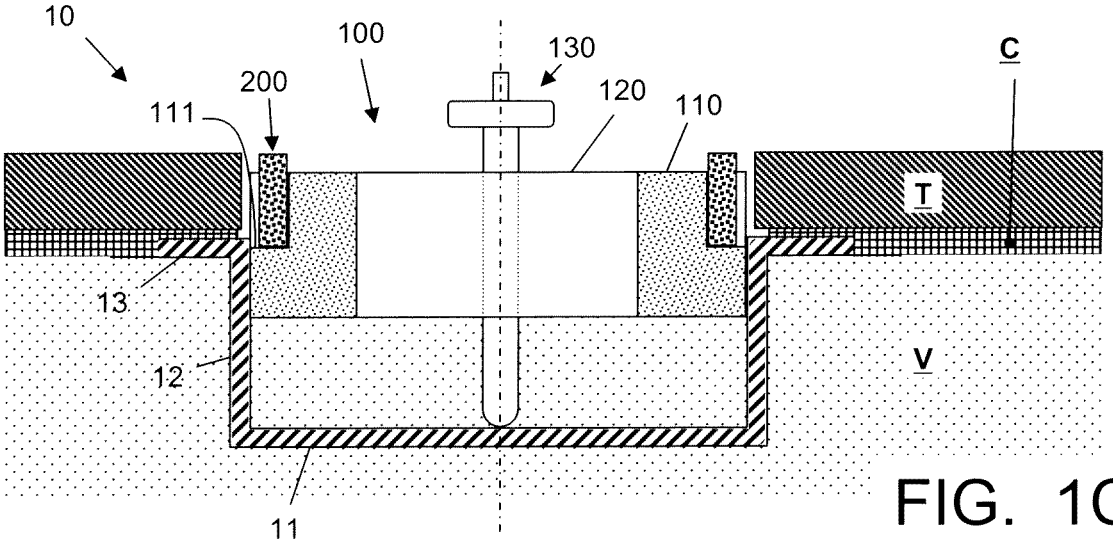

FIG. 1C shows that the collecting container 10 with the covering frame 200 resting on the positioning aid 100 is placed on a subfloor V, and that subsequently tiles T have been arranged on that subfloor V, and glued by means of cement C, which tiles T have been cut to size and extend over the flange 13 to a position close by the covering frame 200. By rotation of the adjustment screws 130, the height of the positioning aid 100 has been adjusted with respect to the bottom 11, and thus the height of the covering frame 200 has been adjusted, such that the upper side of the covering frame 200 lies flush with the upper surface of the tiles T. In practice, of course, one may choose to have the upper side of the covering frame 200 lie slightly lower than the upper surface of the tiles 10.

Figure 1D:
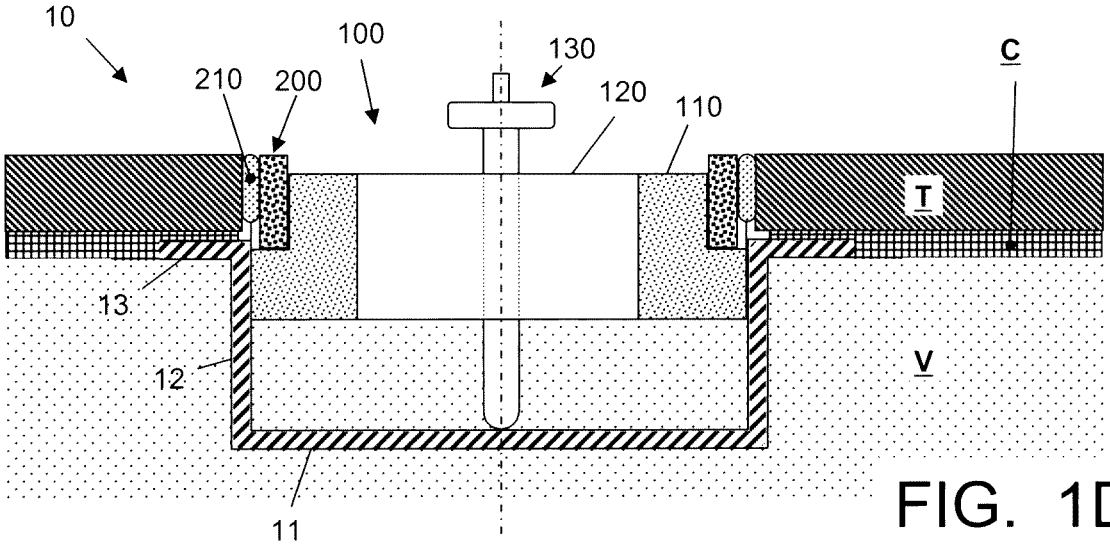

Subsequently, an adhesive 210, for instance in the form of a kit or a mortar, is applied between the covering frame 200 and the tiles T, as shown in FIG. 1D.

Figure 1E:
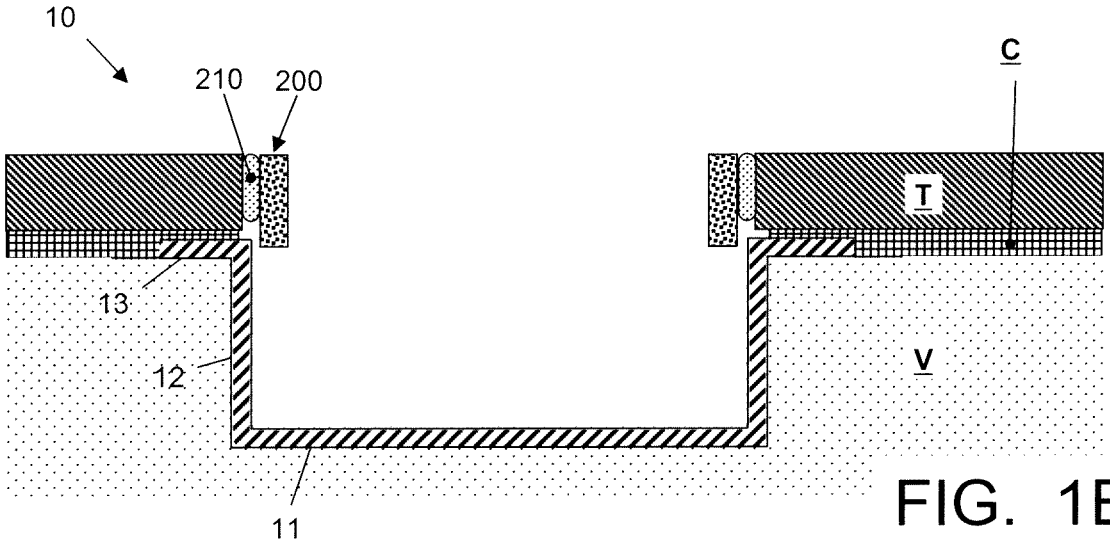

After sufficiently hardening of the adhesive 210, the positioning aid 100 is removed as shown in FIG. 1E, which can simply be done by one of the methods described in the above. This is the final situation, in which the covering frame 200 is suspended from the tiles by means of the adhesive 210, and is thus floating with respect to the drain, which means that the drain is then free from height adjustment means, and particularly there are no support legs or other obstacles supporting on the bottom of the drain and thus hindering the free flow of water.

It is noted that it is possible to first place the positioning aid 100 with the cover frame 200 into the collecting container 10, and to then place the tiles while the frame 200 is already lying in place. In such case, the frame can serve as target on tiling. It is also possible to first do the tiling and then place the positioning aid 100 with the covering frame 200 into the collecting container 10.

Figure 3:
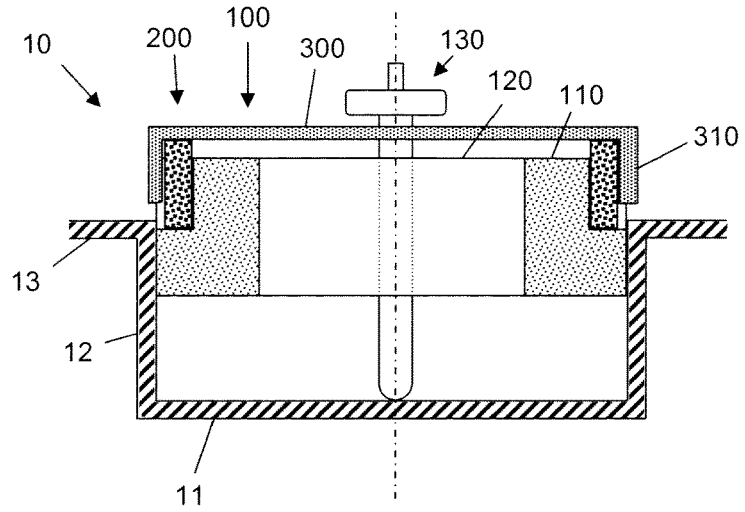
FIGS. 3-5 show variations in detail.

FIG. 3 is a figure comparable to FIG. 1B, showing a variation in which the drain is provided with a temporary covering cap 300 with integrated tile support 310. The covering cap 300 lies over the covering frame 200, and prevents entry of debris into the drain, for instance tile mortar. At its free end, the covering cap 300 is provided with a support edge 310, against which the tiles can be laid on tiling. In this way it can be ensured that the gap between frame and tiles has a same thickness over the full length.

The material of the covering frame 200 is not essential, but will be chosen to resist moisture for a long period of time. Suitable materials are for instance stainless steel, aluminium, copper, brass, plastic, composite.

If the inlet opening of the collecting container 10 has a rectangular shape as in the example described, the covering frame 200 can have four elongate frame segments placed in a rectangular, for instance manufactured by bending a single segment in four places. Or by screwing, gluing, welding four separate segments together or attach them in any other way.

In the embodiment illustrated in FIG. 1, each segment has a rectangular contour in cross section (I-profile).

Figure 4:
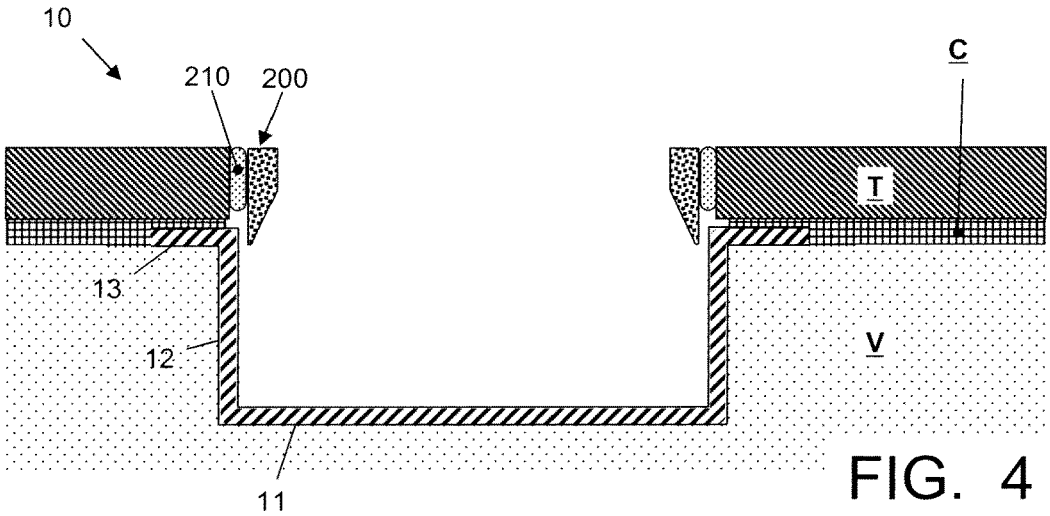

FIG. 4 is a schematic cross section of a variation of the covering frame in which the frame segments at their lower inner sides are bevelled so that cleaning of the wall of the drain directly below the frame is facilitated.

Figure 5:
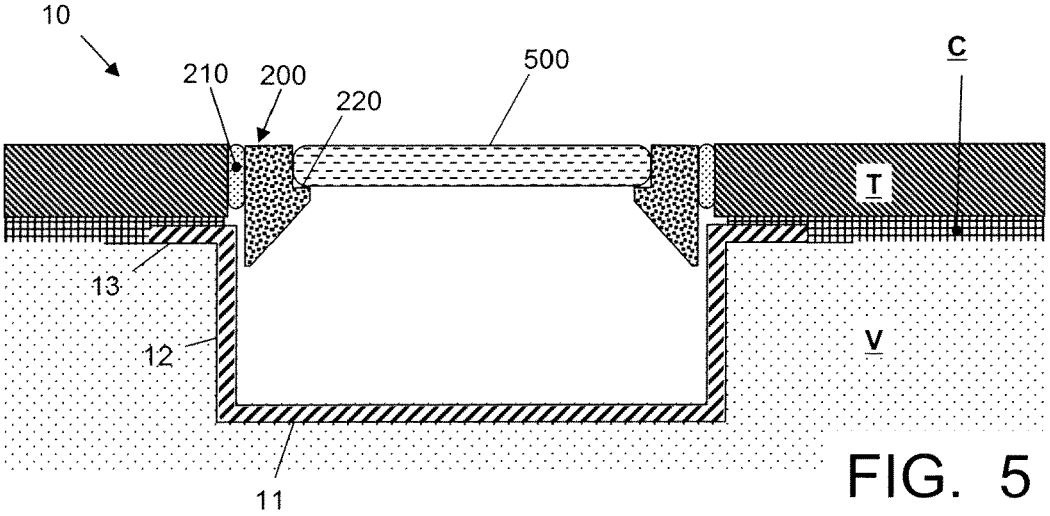

FIG. 5 is a schematic cross section of a variation of the covering frame in which at least two segments at least over a part of their length have an L-shaped contour (L-profile), with a shoulder 220 directed inwards, onto which a grating 500 can be placed. In another variation, the covering frame is mounted slightly lower, in which case its upper edge thus lies slightly below the upper surface of the surrounding tiles. In that case, a plate-shaped cover can be placed on the upper edge of the covering frame, or a plate-shaped flange of a grating structure.

In the embodiment described before, the grating supports on the covering frame 200, and a height adjustment of the grating is thus coupled to the height adjustment of the covering frame 200. That is sufficient in situations where the grating has a fixed height size. However, there are application situations in which the actual height size of the grating is variable; an example of such application situation is when the grating is actually a carrier for a finishing element to be mounted thereon, for instance an ornamental strip or a tile. The thickness of such finishing element then can vary from 1 to perhaps as much as 20 mm, depending on choice and taste of the user. In another variation, the present invention provides in an independent positioning and height adjustment of the grating, in order to be able to compensate for such thickness variations to accomplish that the upper side of such finishing element can lie flush with the upper face of the surrounding tiles.

Figure 6:
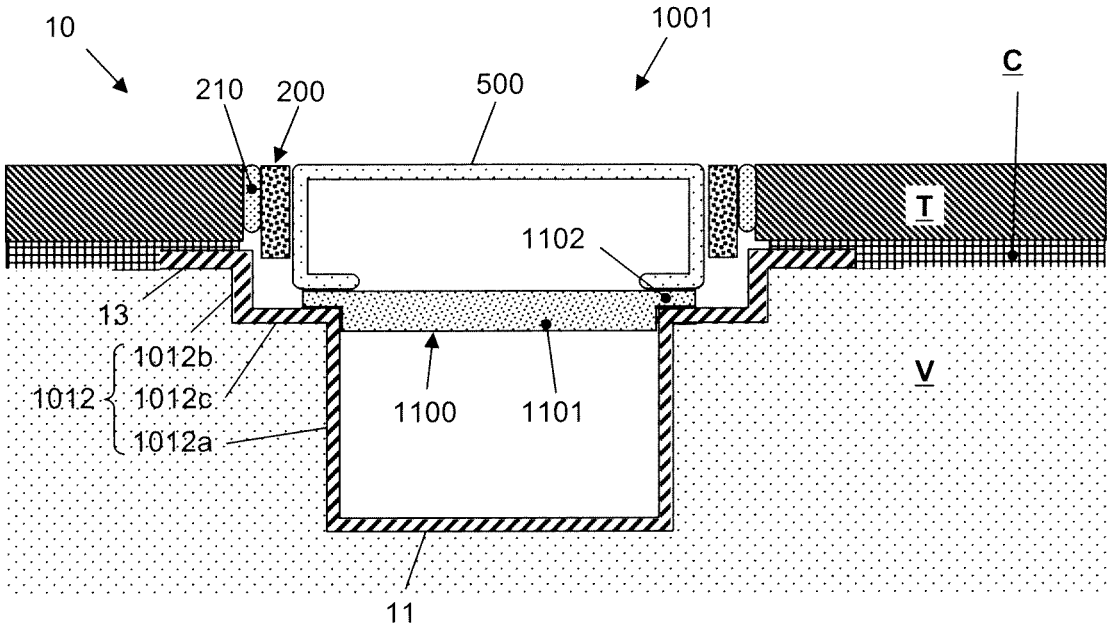
FIG. 6 shows a schematic cross section of another embodiment of a drain with a grating support.

FIG. 6 shows a schematic cross section of a drain 1001, which distinguishes itself from the drain 1 illustrated and discussed in the above by the fact that the two opposite long sidewalls 1012 are stepped. Sidewall 1012 in FIG. 6 thus has a lower wall segment 1012*a* connecting to the bottom 11, and an upper wall segment 1012*b* connecting to the flange 13, with in between a horizontal connecting segment 1012*c* that will be indicated as "step". The two opposite lower wall segments 1012*a* are closer together than the opposite upper wall segments 1012*b*.

The two opposite steps 1012*c* form a bearing for a grating support 1100, onto which a grating 500 is placed. In the example shown, the grating 500 has a reversed U-shape, and has its free edges resting on the grating support 1100, which may for instance be made of plastic.

In the most simple embodiment, the grating support 1100 has the shape of a flat block. In the embodiment shown in FIG. 6, the grating support 1100 has a lower body 1101 with above that a flange part 1102 wider than the lower body 1101. The lower body 1101 has a width matching the horizontal distance between the two opposite lower wall segments 1012*a*, and thus ensures a horizontal positioning of the grating support 1100. The flange part 1102 rests on the two opposite steps 1012*c*.

Figure 7:
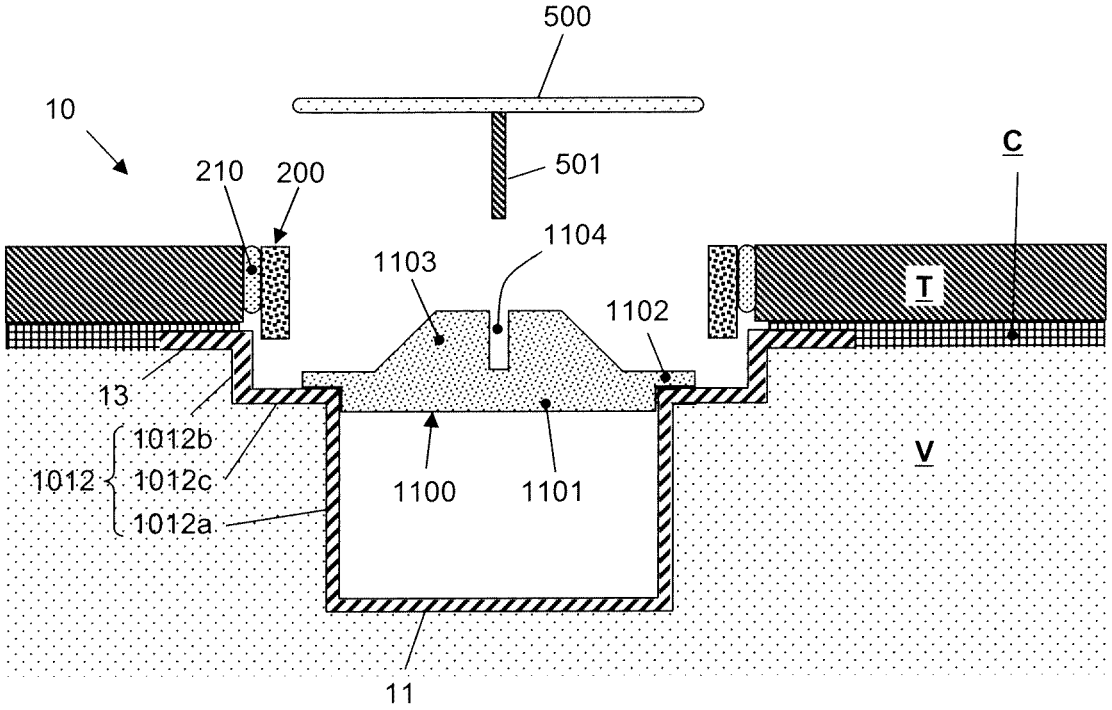
FIG. 7 shows a schematic cross section of the drain of FIG. 6 with another grating support.

FIG. 7 shows a cross section comparable to FIG. 6 of the drain 1001, wherein the grating support 1100 further has an upper body 1103 above the flange part 1102. At its upper side, the upper body 1103 is provided with a horizontal groove 1104. In this embodiment, the grating 500 is at its lower side provided with a strip 501 extending downwards, fitting clampedly in said groove. An advantage of this clamping attachment is that, when one removes the grating, also the grating support comes along automatically, and then the entire drain bottom is free and can be cleaned.

An adjustment of the grating 500, independent from the covering frame 200, is possible by providing a system of multiple grating supports 1100 wherein the thickness of the flange part 1102 can vary. In such case, height adjustment is possible by exchanging grating supports 1100. It is also possible to provide additional adjustment blocks that can be clamped under the grating support in order to affect a higher adjustment position.

Figure 8:
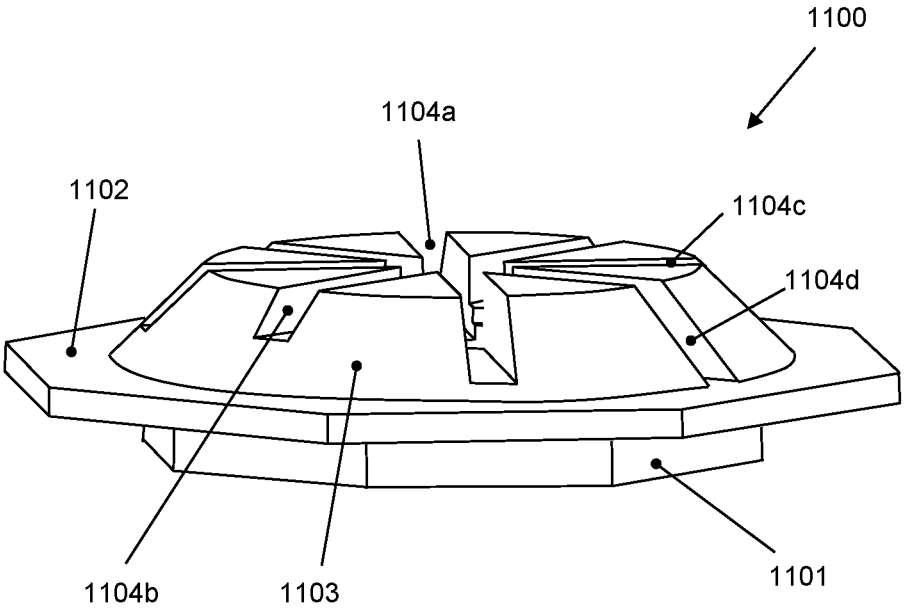
FIG. 8 shows a perspective view of an embodiment of a grating support.

In a special variation of embodiment, the grating support 1100 has multiple rotational positions, defining different clamping heights of the grating 500. FIG. 8 shows a perspective view of an embodiment of a grating support 1100 of which in any case the lower body 1101 in top view has an octangular contour, such that this fits within the lower drain walls 1012*a* in eight different positions. Corresponding to these eight different positions, four grooves 11014*a*, 1104*b*, 1104*c*, 1104*d* are arranged in the upper body 1103, enclosing angles of 45° with each other, and which differ with respect to each other by different groove depth. Depending on the rotation position chosen, one of these grooves is operational to receive the coupling strip 501 of the grating 500 extending downwards.

In all cases mentioned, according to the present invention the advantage is achieved that the bottom of the drain is free accessible for cleaning purposes. During use, the grating support remains free from the bottom and does not form an obstruction for draining water. The frame suspended from the tiles can serve as grating support. A separate grating support may also be provided, in order to enable an independent height adjustment of the grating.

It will be clear to a person skilled in the art that the invention is not limited to the exemplary embodiments discussed in the above, but that several variations and modifications are possible within the protective scope of the invention as defined in the attached claims. For instance, the tiles T may be replaced by another finishing layer of the floor.

In the figures, the drain is shown with a horizontal layer of tiles at both sides. It is also possible that the drain is placed close to the wall of a shower space.

In the figures, the collecting container is shown as fitting precisely within a recess or void, profiled or not, in the floor V. It is also possible that this recess or void is larger, and that the space remaining between the collecting container and the floor material is filled wholly or in part with supporting material and/or filling material. It is also possible that the connecting container is laid onto the subfloor.

Figure 9:
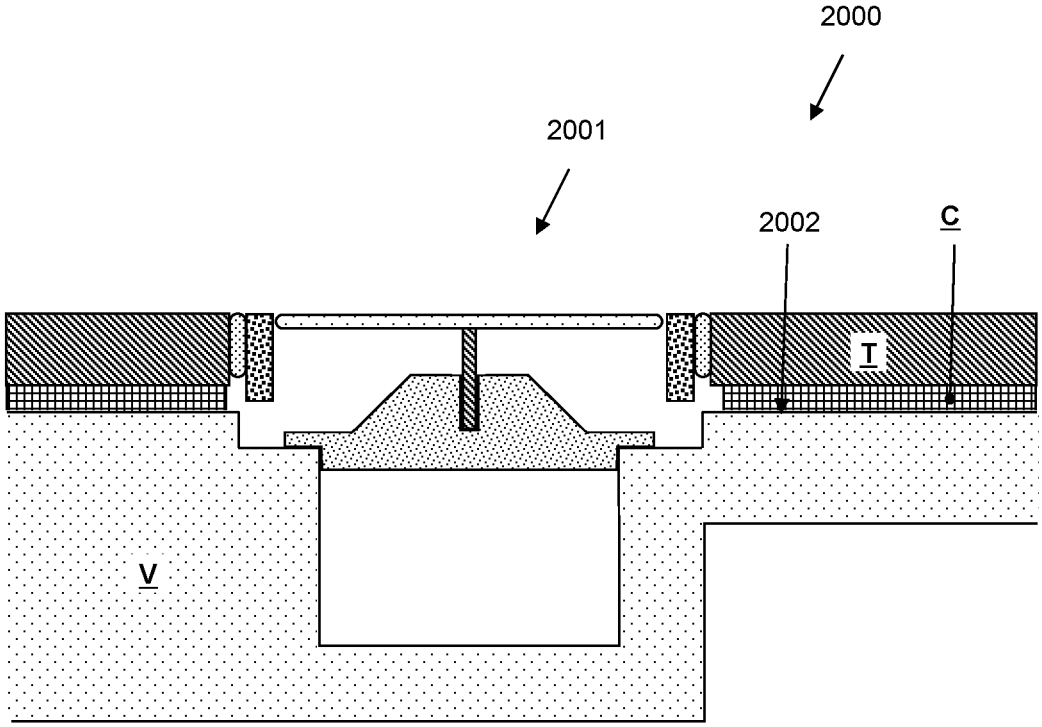
FIG. 9 shows a schematic cross section of a shower tray with integrated drain.

In the above, the invention has been described for a drain to be placed on a subfloor V. The present invention is however also applicable if the drain forms an integrated whole with the "floor" to be tiled, for instance in the case of a shower tray with integrated drain. In the case of such shower tray, which may have been made as a single form piece of any material, for instance plastic, the same problems occur as described in the above when one wishes to tile this shower tray, and the present invention offers the same advantages as described in the above. In this case, the bottom surface of the shower tray fulfils the functions described above of subfloor and flange for arranging tiles thereon. By way of example, FIG. 9 shows a cross section comparable to FIG. 7 of a part of a shower 2000 with integrated drain 2001. Reference numeral 2002 indicates the bottom of the shower tray 2000. In the right hand half, the figure shows that the shower tray 2000 can be a tray with thick walls that leaves a hollow space between the tray and the subfloor, and in the left hand half, the figure shows that the shower tray 2000 can have a solid plate-shape. In either case, as far as arranging tiles T is concerned, the tray accomplishes the function of subfloor V.

Apart from the shape of the drain, the present invention also comes to expression already in;

- the combination of a covering frame and adhesive to adhere this covering frame to side edges of tiles;
- a positioning aid;
- a grating support;
- a drain or shower tray with a collecting container having stepped side walls.

Even if certain features are mentioned in different dependent claims, the present invention also relates to an embodiment having these features in common. Even if certain features are described in combination with each other, the present invention also relates to an embodiment in which one or more of these features are omitted. Features that have not been explicitly described as being essential may also be omitted. Possible reference numerals used in a claim should not be interpreted as limiting the scope of that claim.

The invention claimed is:

1. A drain configured to be proximate tiles comprising:
- a collecting container with a bottom and standing side walls, wherein the collecting container is configured such that tiles extend to upper ends of the side walls;
- a covering frame configured to be:
  - suspended floatingly from side edges of the tiles by an adhesive; and
  - covering the side edges of the tiles;
- a grating; and
- separate height adjustment means for the grating;
- wherein the standing side walls of the collecting container have steps;
- wherein the height adjustment means for the grating comprise a grating support resting on the steps; and
- wherein the grating is supported on the grating support.

2. A drain combination comprising:
- the drain according to claim 1; and
- a floor system comprising one of:
  - a floor with the tiles arranged thereon and the drain mounted in or on the floor; and
  - a shower tray with the drain integrated therein and the tiles arranged on the shower tray.

3. The combination according to claim 2, wherein the covering frame has an upper edge that lies from lower than to flush with an upper surface of the tiles.

4. The combination according to claim 2, wherein the grating carries one or multiple finishing elements.

5. The combination according to claim 2 further comprising:
- the adhesive for floatingly suspending the covering frame from the tiles.

6. The drain according to claim 1, wherein the grating support has multiple rotation positions within the collecting container, corresponding to different height positions of the grating.

7. The drain according to claim 1 further comprising:

the adhesive for floatingly suspending the covering frame from the tiles.

8. The drain according to claim 1 further comprising:

a positioning aid that is placeable in the collecting container; and height adjustment means for adjusting the height of the positioning aid with respect to the container bottom;

wherein the positioning aid is suitable to:

receive the covering frame; and keep the covering frame in a desired position temporarily.

9. The drain according to claim 8, wherein the positioning aid is made of a material selected from the group consisting of cardboard, styrofoam, and papier-mache.

10. The drain according to claim 8, wherein the positioning aid is designed to be easily deformed to a smaller shape.

11. The drain according to claim 8, wherein the positioning aid is provided with pre-shaped folding lines and/or tearing lines.

12. The drain according to claim 8, wherein the positioning aid comprises separate components that can shift or hinge with respect to each other.

13. The drain according to claim 8, wherein the positioning aid comprises a collection of positioning parts that are smaller than a passage of the covering frame and that can be height-adjusted individually.

14. The drain according to claim 8, wherein the positioning aid is designed for one time use.

15. A method comprising the steps of:

providing the drain according to claim 1, wherein the drain is configured for mounting in or on a floor, or is integrated in a shower tray positioning and holding the covering frame at a desired height; and arranging an adhesive between the covering frame and the tiles in order to suspend the covering frame from the tiles;

wherein:

if the drain is configured for mounting in or on a floor, the method further comprises, between providing and positioning:

placing the collecting container in or on the floor; and arranging the tiles on the floor, extending to the proximity of the upper edges of the side walls of the collecting container; or if the drain is integrated in a shower tray, the method further comprises, between providing and positioning:

arranging the tiles on a bottom of the shower tray, extending to the proximity of the upper edges of the side walls of the collecting container.

16. The method according to claim 15, wherein positioning and holding the covering frame at the desired height comprises the steps of:

providing a temporary positioning aid provided with aid height adjustment means;

placing the positioning aid in the collecting container, wherein the aid height adjustment means is supported on the collecting container; and allowing the covering frame to be supported on the positioning aid by means of the aid height adjustment means, setting the height of the covering frame;

wherein the method comprises the further step of:

after the adhesive has set, subsequently removing the positioning aid, so that the covering frame suspends from the tiles.

17. The method according to claim 16, wherein the positioning aid is for one time use; and wherein the step of removing the positioning aid is a destructive step.

18. The method according to claim 16, wherein the positioning aid is reusable; and wherein the step of removing the positioning aid is a non-destructive step.

19. The drain according to claim 1, wherein the bottom of the drain is free from height adjustment means.

20. The drain according to claim 1, wherein the grating support comprises:

a lower body; and a flange part above the lower body, the flange part being wider than the lower body;

wherein the flange part is configured for resting on opposite steps of the standing side walls of the collecting container; and wherein the lower body has a width matching a horizontal distance between corresponding two opposite side walls of the collecting container.

21. The drain according to claim 20, wherein the grating support has multiple rotation positions within the collecting container, each of the rotation positions corresponding to a different height position of the grating; and wherein the lower body, in each of the rotation positions, has a width matching the horizontal distance between the corresponding two opposite side walls of the collecting container.

22. The drain according to claim 21, wherein the grating has a downward extending coupling strip;

wherein the grating support further comprises coupling grooves for receiving the downward extending coupling strip;

wherein each coupling groove corresponds to a respective one of the rotation positions;

wherein each coupling groove has a groove depth; and wherein each groove depth is different one from another.

23. The drain according to claim 22, wherein the downward extending coupling strip fits clampedly in the respective coupling groove.

24. The drain according to claim 20, wherein the lower body has a polygon shape with an even number of sides.

25. The drain according to claim 24, wherein the lower body has an octangular contour.

26. A shower tray with the drain according to claim 1 integrated therewith.

27. A grating support configured for use with a drain and comprising:

coupling grooves for receiving a downward extending coupling strip of a grating of the drain;

wherein:

the grating support has multiple rotation positions, each of the rotation positions corresponding to a different height position of the grating;

each coupling groove corresponds to a respective one of the rotation positions;

each coupling groove has a groove depth;

each groove depth is different one from another;

the drain further comprises:

a collecting container with a bottom and standing side walls, wherein the collecting container is configured such that tiles extend to upper ends of the side walls; and a covering frame configured to be:

suspended floatingly from side edges of the tiles by an adhesive; and covering the side edges of the tiles;

wherein the standing side walls of the collecting container have steps; and the grating support being further configured to:

support the grating of the drain; and rest on opposite steps of the standing side walls of the collecting container of the drain.

28. The grating support according to claim 27 further comprising:

a lower body; and a flange part above the lower body, the flange part being wider than the lower body;

wherein the lower body, in each of the rotation positions, always has the same width.

29. A grating support configured for a drain and comprising:

coupling grooves for receiving a downward extending coupling strip of a grating of the drain;

wherein the grating support is configured to:

support the grating of the drain; and rest on opposite steps of standing side walls of a collecting container of the drain;

wherein the grating support has multiple rotation positions, each of the rotation positions corresponding to a different height position of the grating;

wherein each coupling groove corresponds to a respective one of the rotation positions;

wherein each coupling groove has a groove depth; and wherein each groove depth is different one from another.

30. The grating support according to claim 29 further comprising:

a lower body; and a flange part above the lower body, the flange part being wider than the lower body;

wherein the lower body, in each of the rotation positions, always has the same width.

31. The grating support according to claim 30, wherein the lower body has a polygon shape with an even number of sides.

32. The grating support according to claim 31, wherein the lower body has an octangular contour.

* * * * *